United States Patent [19]

Craig et al.

[11] Patent Number: 4,941,914

[45] Date of Patent: Jul. 17, 1990

[54] DESULFURIZATION AGENT

[75] Inventors: Donald B. Craig, Grand Island; Thomas K. McCluhan, Tonawanda, both of N.Y.

[73] Assignee: Elkem Metals Company, Pittsburgh, Pa.

[21] Appl. No.: 353,700

[22] Filed: May 18, 1989

[51] Int. Cl.[5] ..... C21C 7/02

[52] U.S. Cl. ..... 75/309; 75/312; 75/310; 75/565

[58] Field of Search ..... 75/53, 58

[56] References Cited

U.S. PATENT DOCUMENTS

| | | | |
|---|---|---|---|
| 4,076,522 | 2/1978 | Yoshida | 75/58 |
| 4,260,413 | 4/1981 | Freissmuth et al. | 75/58 |
| 4,279,643 | 7/1981 | Jackman | 75/58 |
| 4,417,924 | 11/1983 | Schwer | 75/58 |
| 4,462,823 | 7/1984 | Fontaine | 75/58 |
| 4,490,173 | 12/1984 | Schwer | 75/58 |
| 4,541,867 | 9/1985 | Neelameggham | 75/58 |
| 4,572,737 | 2/1986 | Robinson et al. | 75/58 |
| 4,687,512 | 8/1987 | Schrodter | 75/58 |
| 4,753,676 | 6/1988 | Kodatsky et al. | 75/58 |
| 4,764,211 | 8/1988 | Meichsner et al. | 75/58 |

OTHER PUBLICATIONS

Kirk-Othmer—Encyclopedia of Chemical Technology—vol. 4, p. 508.

"Improved Calcium Carbide for Iron Desulfurization", R. W. Bartram et al.

"Hot Metal Desulfurization-N. American Experience with CaD", H. A. Corver et al., Iron and Steel Engineer, May 1980, pp. 53-55.

"The Activity of Iron Oxide in ($CaO+CaF_2+SiO_2+Fe_xO$) Slags", M. J. U. T. van Wijngaarden et al., Transactions of the ISS, Feb. 1988, I&SM-49-56.

"The Kinetics of Sulfur Transport Between Slag and Molten Iron Droplets", W. N. Bargeron et al., AFS Transactions, pp. 303-310.

"Slags and Fluxes for Ferrous Ladle Metallurgy", E. T. Turkdogan, Iron and Steelmaking, 1985, vol. 12, No. 2, pp. 64-78.

"Desulfurization of Hot Metal with Burnt Lime", Tatsuo Ohya et al., Steelmaking Proceedings, 1977, pp. 90-97.

"Efficiency in Desulfurization Practices", W. A. Henning, Elkem Metals Company, Jun. 6, 1986.

"Hot Metal Desulfurization by CO Injection of Calcium Carbide and Magnesium", Thomas Bieniosek, LTV Steel Company, pp. 349-356.

"Desulfurizing of Molten Iron Droplets While Floating on Slag Baths", W. N. Bargeron, P. K. Trojan, R. A. Flinn, AFS Transactions, pp. 117-124.

*Primary Examiner*—Peter D. Rosenberg

*Attorney, Agent, or Firm*—Lucas & Just

[57] ABSTRACT

The desulfurization agent for molten iron is made up of 95 to 70% commercial calcium carbide, 30 to 5% calcium aluminate slag, and 10 to 0% of a metal oxide. The calcium aluminate slag is made up of 65 to 50% calcium oxide, 35 to 25% aluminum oxide, and 12 to 3% calcium fluoride. The metal oxides are ferric oxide, manganomanganic oxide and ferrosoferric oxide. The desulfurizing agent has been found to reduce the amount of calcium carbide in the resulting slag.

12 Claims, No Drawings

DESULFURIZATION AGENT

This invention relates to a desulfurization agent for molten iron and more particularly for ductile iron. A method for reducing the residual calcium carbide in slag produced during desulfurization of molten iron has also been discovered.

Conventionally, desulfurization of iron in a foundry is significantly different from desulfurization in integrated steel mills. For instance, the slag phase in a steel desulfurization process is typically in a liquid state while the slag in a foundry process is typically in a solid state.

Conventionally, desulfurization of iron is conducted subsequent to the cupola or other melting unit by the addition of a desulfurization agent to a melt of molten iron in a ladle. In the case of ductile iron, granulated commercial calcium carbide is the standard desulfurization agent. Generally, commercial calcium carbide is added to a stream of molten iron as it enters a ladle equipped with a porous plug. The porous plug bubbles an inert gas such as argon or nitrogen through the molten iron in order to obtain good mixing between the calcium carbide and liquid iron. Other mechanical and pneumatic mixing devices are also employed on occasion.

Commercial calcium carbide, also referred to as technical, industrial or foundry grade, comprises about 70 to about 85% by weight calcium carbide, $CaC_2$, and about 15 to about 25% by weight of a mixture of calcium oxide, CaO, and calcium hydroxide, $Ca(OH)_2$; the remaining about 5% is miscellaneous ingredients.

For desulfurizing iron, calcium carbide in combination with other compounds has been suggested in the art. Specifically, U.S. Pat. No. 4,260,413 issued Apr. 7, 1981 teaches coating calcium carbide with carbon as a lubricant to increase storage life and improve flowability of calcium carbide.

U.S. Pat. No. 4,572,737 issued Feb. 25, 1986 teaches coating calcium carbide with a compound having a contact angle with the molten iron that is less than the contact angle of calcium carbide with the molten iron. The suggested compounds used to coat the calcium carbide are titanium oxide, ferric oxide ($Fe_2O_3$), calcium aluminate ($3CaO.Al_2O_3$), calcium hydroxide ($Ca(OH)_2$), fluorspar ($CaF_2$), iron powder, fumed titania, and fumed silica. A binding agent can be used to adhere the coating compound to the calcium carbide.

U.S. Pat. No. 4,753,676 issued June 28, 1988 teaches a process for desulfurizing iron melts using a mixture of commercial calcium carbide and diamide lime.

U.S. Pat. No. 4,764,211 issued Oct. 16, 1988 teaches using a mixture of industrial calcium and dried coal which contains at least 15% by weight of volatile constituents. Magnesium, aluminum oxide, aluminum, and fluorspar may also be included in the desulfurization agent of the '211 patent.

In the iron melt, calcium carbide is thought to react with sulfur in a liquid-solid reaction to form calcium sulfide (CaS). The calcium sulfide is thought in part to form a surface layer on the calcium carbide particle and hinder further reaction between the calcium carbide and sulfur. The calcium carbide/calcium sulfide, calcium carbide and calcium sulfide are solids in the iron melt and tend to rise to the top of the melt. At the top of the melt these solid materials form a slag phase and are removed as a slag from the top of the melt. Typically, in the desulfurization process of iron with commercial calcium carbide, the calcium carbide is not entirely consumed and the slag removed from the melt contains residual calcium carbide. Disposal of this slag can create a potential problem because the residual calcium carbide can be converted to acetylene when it comes into contact with water, either as humidity or as a liquid.

The slag from the desulfurization process of molten iron has come under the scrutiny of the United States Environmental Protection Agency and, if the amount of residual calcium carbide in the slag is too high, the slag may be classified as a hazardous waste. Needless to say, there is a need to reduce the amount of residual calcium carbide in slag.

The '676 patent alleges that the use of commercial calcium in combination with diamide lime reduces the amount of residual calcium carbide in slag.

A method for reducing the amount of residual calcium carbide in slag has now been discovered. The present invention is an improved process for desulfurizing an iron melt wherein a desulfurization agent is mixed with a melt and a resulting slag is removed from the surface of the melt, the improvement comprising mixing a desulfurizing agent comprising a homogeneous mixture of commercial calcium carbide and calcium aluminate slag, the slag comprising a homogeneous mixture of calcium oxide, aluminum oxide and calcium fluoride with the desulfurization agent minimizing the amount of residual calcium carbide in the slag removed from the surface of the melt.

The desulfurization agent of the present invention comprises commercial calcium carbide and a calcium aluminate slag comprising calcium oxide, aluminum oxide, and calcium fluoride. Preferably, a metal oxide selected from the group consisting of ferric oxide ($Fe_2O_3$), manganomanganic oxide ($Mn_3O_4$), and ferrosoferric oxide ($Fe_3O_4$) is included in the formulation of the desulfurizing agent of the present invention.

It has been found that by employing the desulfurizing agent of the present invention, a slag low in residual calcium carbide is produced.

It was both surprising and unexpected that the combination of calcium carbide and a calcium aluminate slag comprising calcium oxide, aluminum oxide and calcium fluoride lowered the amount of residual calcium carbide in the slag. It was also surprising that this combination worked as a desulfurization agent because calcium aluminate slag comprising calcium oxide, calcium fluoride and aluminum oxide, although known to aid in desulfurization of steel melts, is not known to aid in the desulfurization of iron melts. It was also surprising and unexpected that the addition of a metal oxide helped to desulfurize the iron melts because it has generally been thought that iron oxides, and especially manganomanganic oxide, hinder desulfurization of iron melts.

More specifically, a method has been discovered for reducing residual calcium carbide in slag obtained from a conventional process of desulfurizing an iron melt with commercial calcium carbide. The method comprises forming a mixture of commercial calcium carbide and a calcium aluminate slag comprising calcium oxide, aluminum oxide, and calcium fluoride; desulfurizing said iron melt with said mixture; and recovering a slag low in calcium carbide.

More preferably, the step of forming the mixture of commercial calcium carbide and the calcium aluminate slag includes the step of adding a metal oxide selected from the group consisting of ferric oxide, manganomanganic oxide, and ferrosoferric oxide to said mixture.

Preferably, the desulfurizing agent of the present invention comprises about 95 to about 70% by weight of commercial calcium carbide; about 5 to about 30% by weight of a calcium aluminate slag, said calcium aluminate slag comprising about 65 to about 50% by weight calcium oxide, about 25 to about 35% by weight aluminum oxide, about 3 to about 12% by weight calcium fluoride; and about 0 to about 10% by weight of a metal oxide selected from the group consisting of ferric oxide, manganomanganic oxide and ferrosoferric oxide.

More preferably the desulfurization agent of the present invention comprises about 90 to about 75% by weight commercial calcium carbide, about 10 to about 20% by weight of said calcium aluminate slag and about 1 to about 6% by weight of said metal oxide.

Even more preferred is a desulfurization agent comprising about 85 to about 80% by weight commercial calcium carbide, about 13 to about 17% by weight said calcium aluminate slag, and about 2 to about 4% by weight of said metal oxide.

More preferably, the calcium aluminate slag comprises about 58 to about 52% by weight calcium oxide, about 25 to about 32% by weight aluminum oxide, and about 9 to about 5% by weight calcium fluoride.

Good results have been obtained with a calcium aluminate slag that consists essentially of calcium oxide, aluminum oxide, and calcium fluoride in the proportions as stated above. One of skill in the art will realize that, in making the calcium aluminate slag, tramp elements will be present in the calcium aluminate slag. Preferably, the amount of tramp elements is below about 10% by weight of calcium aluminate slag. Typically, the tramps include silicon dioxide, iron oxide and titanium dioxide. Silicon dioxide is typically present in an amount less than about 5% by weight, iron oxide less than about 3% by weight, and titanium dioxide less than about 2% by weight.

Good results have been obtained with the desulfurization agent of the present invention consisting essentially of the components listed above in their stated proportions.

The desulfurization agent of the present invention is used in a particulate form, preferably 12 mesh×30 mesh. The particulate form can be made from a loose homogeneous mixture of ingredients or, more preferably, by compacting a homogeneous loose mixture of ingredients and sizing the compacted product to the preferred size to form a homogeneous, compacted mixture of the desulfurizing agent of the present invention. Compacting is done in a conventional and convenient manner.

Forming the homogeneous, compacted mixture of the desulfurization agent of the present invention is done in a conventional manner. Preferably, weighted portions of the calcium aluminate slag, commercial calcium carbide and metal oxide are placed on a continuous belt and subjected to a conventional roll compactor which forms a continuous sheet of material. Next, the sheet is passed through a granulator. The granulated sheet is then sized with conventional screens. The oversized goes to a hammer mill while the undersized goes back to the belt. It is important that the components of the desulfurization agent of the present invention are homogeneously mixed together and held in close association with each other. The commercial calcium carbide helps to bind and hold all the components in close association with each other. A binder such as asphalt could be used; however, such a binder is not preferred because of the smoke and soot evolved when the desulfurization agent of the present invention is added to the melt. Preferably, the calcium carbide binds the components together and holds them in close proximity to each other. During compaction, it has been found that the calcium carbide is forced to flow and will at least partially encompass the other components of the desulfurization agent of the present invention. It is noted that the calcium aluminate slag and the metal oxide do not in any way coat the calcium carbide.

The phrase "commercial calcium carbide" as used in the specification and claims means commercial or industrial grade calcium carbide. Commercial calcium carbide comprises about 70 to about 85% by weight pure calcium carbide, $CaC_2$, about 15 to about 25% by weight of a mixture of calcium oxide, CaO, and calcium hydroxide, $Ca(OH)_2$, and less than about 5% miscellaneous ingredients. The commercial calcium carbide has a size of about 30×D and more preferably 30 mesh by 150 mesh.

The desulfurization agent of the present invention when made with commercial calcium carbide comprises about 78 to about 50% by weight of pure calcium carbide; about 12 to about 30% by weight of a mixture of calcium oxide and calcium hydroxide; about 5 to about 30% by weight of a calcium aluminate slag, said calcium aluminate slag comprising about 65 to about 50% by weight calcium oxide, about 25 to about 35% by weight aluminum oxide, about 3 to about 12% by weight calcium fluoride; and about 0 to about 10% by weight of a metal oxide selected from the group consisting of ferric oxide, manganomanganic oxide aand ferrosoferric oxide.

More preferably, the desulfurization agent of the present invention comprises about 75 to about 55% by weight pure calcium carbide; about 15 to about 25% by weight of a mixture of calcium oxide and calcium hydroxide; about 10 to 20% by weight of said calcium aluminate slag; and about 1 to about 6% by weight of said metal oxide.

Even more preferred is a desufurization agent comprising about 70 to about 60% by weight pure calcium carbide; about 16 to about 20% by weight of a mixture of calcium oxide and calcium hydroxide; about 13 to about 17% by weight said calcium aluminate slag; and about 2 to about 4% by weight of said metal oxide.

Conventional sources of particulate manganomanganic oxide, $Mn_3O_4$, are used in the present invention. Suitable sources of manganomanganic oxide include reagent grade and pigment grade. Another possible source of manganomanganic oxide is from the fume from the smoke stacks of a ferromanganese refining vessel. Preferably, the manganomanganic oxide has a particle size of about 140 mesh×D. Typically, the chemical analysis of a suitable pigment grade manganomanganic oxide is about 60 to about 70% manganese, about 1 to about 2% iron, about 1 to about 5% calcium oxide, and about 1 to about 5% magnesium oxide.

A conventional source of particulate ferric oxide, $Fe_2O_3$, is used in the present invention. Ferric oxide, also known as red iron oxide, nonmagnetic iron oxide, and red rouge, is typically about 100% $Fe_2O_3$. Suitable sources of ferric oxide include reagent grade and pigment grade.

Any conventional source of ferrosoferric oxide, $Fe_3O_4$, is used. Ferrosoferric oxide, also known as black iron oxide, ferroferric oxide, magnetic iron oxide, and black rouge, has a typical composition of about 50% by weight FeO and about 50% by weight ferric oxide, $Fe_2O_3$. A suitable source of ferrosoferric oxide is pigment grade. The ferrosoferric oxide is in particulate form.

In order to make the preferred calcium aluminate slag of the present invention, appropriate amounts of calcium oxide, calcium fluoride, and aluminum oxide are mixed and heated to form a molten mass. The mass is then rapidly cooled to a solid state. The molten mass can be formed in a conventional melting unit. The liquid mass is then poured on a casting floor to form a sheet about 0.75 inches (2 cm) thick. The cast sheet is allowed to cool under ambient conditions. Preferably, the slag is mixed before pouring to obtain thorough dispersion of all components in the molten mass. The poured liquid slag should solidify upon contact with the casting floor.

Finally, the calcium aluminate slag is crushed in a conventional manner to a size similar to the commercial calcium carbide and preferably to about 30×D.

Any conventional source of calcium oxide, CaO, can be used. Typically, lime is used having a particle size of about 2"×4".

Any conventional source of aluminum oxide can be used. Preferably bauxite is used having a particle size of about 1"×D.

Any conventional source of calcium fluoride can be used. Preferably fluorspar is used having a particle size of about ½"×D.

Preferably, the three components of the calcium slag are melted together and then rapidly solidified to form a homogeneous mixture of the three components. Alternatively, and less preferably, all three components are physically mixed together in a particulate form and then compacted to provide a closely associated, homogeneous mixture of the three. As noted above, commercial calcium carbide is forced to flow and bind around the calcium aluminate slag and metal oxide during the compacting process. All three components of the calcium aluminate slag can be mixed in particulate form with the commercial calcium carbonate and preferably the metal oxide and the commercial calcium carbide will flow around and bind all particulate components to make a homogeneous, compacted product.

It should be noted that the weight percents of the various components of the calcium aluminate slag are based on the total weight of calcium aluminate slag, not the final desulfurization agent.

It will be understood that the calcium oxide present in the desulfurization agent of the present invention comes from both the commercial calcium carbide and the calcium aluminate slag. This calcium oxide is present in the desulfurization agent of the present invention as being calcium oxide and calcium hydroxide and typically is present in an amount between about 15 to 50% by weight based on the weight of the desulfurization agent.

The melt of iron is desulfurized in a conventional manner using the desulfurization agent of the present invention. Good results have been obtained in both continuous and batch operations by addition of the desulfurization agent to a stream of molten iron as it is poured into the mixing ladle.

The desulfurization agent of the present invention is added to the molten iron in an amount between about 0.2% to about 2.0% by weight molten iron. In fact, it has been found that the desulfurization agent of the present invention can be substituted on a 1:1 weight basis in commercial operations for conventional commercial calcium carbide.

These and other aspects of the present invention may be more fully understood by reference to the following examples.

EXAMPLE 1

This example compares commercial calcium carbide to the present invention.

Table 1 below lists the results. It can be seen that the desulfurization agent of the present invention produced a slag lower in calcium carbide than the slag produced from a desulfurization step with commercial calcium carbide.

TABLE 1

| | Desulfurization Agents (% by weight) | |
|---|---|---|
| | A | B |
| Initial Sulfur in Iron Melt* | 0.10 | 0.10 |
| Final Sulfur in Iron Melt* | 0.010 | 0.005 |
| Residual $CaC_2$ in Slag | 3.06 | 1.44 |
| Amount Commercial $CaC_2$ in Agent | 100 | 80 |
| Amount CAS** in Agent | 0 | 20 |

*average of the three tests
**calcium aluminate slag

The calcium aluminate slag was made by forming a molten mass of a commercial grade of lime with a commercial grade of fluorspar and a commercial grade of aluminum oxide and then quickly cooling the mass. The molten mass had a temperature of about 1600° C. To cool, the molten mass was poured onto a casting floor where it solidified on contact forming a solid sheet of about 0.75 inch (2.0 cm) thick. This was then crushed to a particle having a size of 30 mesh×D.

The desulfurization agent of the present invention, B, used in this example was made by mixing a particulate calcium aluminate slag made in a manner illustrated above with a particulate commercial calcium carbide, 30 mesh×200 mesh. The desulfurization agent was in loose particulate form and not compacted when added to the molten iron melt.

The following procedures were used to conduct the above-identified tests. Using an induction furnace, a total of six melts of molten iron were prepared, three for testing with calcium carbide and three with the present invention. Each melt weighed 75 pounds (34 Kg) and had a typical chemical analysis of:

| Typical Melt Chemical Analysis % by Weight | |
|---|---|
| Iron | Balance |
| Carbon | 3.6 |
| Phophorous | 0.02 |
| Sulfur | 0.1 |
| Manganese | 0.6 |
| Silicon | 2.0 |

To each melt, 0.75 pounds (340 grams) of desulfurization agent was added (1% addition). The agent was added as a particulate and argon was bubbled in through a graphite tube positioned in the middle of the melt. The purpose of the gas was to provide mixing within the furnace crucible. The temperature of the molten iron was 1475° C. The melt was treated for about 8 minutes and then the slag was skimmed off the top of the melt. Samples of the molten iron were taken for sulfur analysis before treatment with the desulfurization agent, and after treatment with the desulfurization agent at 2 minute intervals, measured from the addition of the desulfurization agent. A conventional combustion technique was used to determine the sulfur content of the molten iron.

Residual calcium carbide in the slag was determined by placing a 2 to 3 g sample of slag in a beaker of water. The water totally covered the slag. The initial weight of water plus slag was taken. The beaker was then allowed to stand under ambient conditions for a period of 15 minutes and reweighed. The difference in weight is presumed to be due to evolution of acetylene gas. From this presumption, the amount of calcium carbide in the slag is calculated.

EXAMPLE 2

This example compares calcium carbide as a desulfurization agent to the present invention. The results of this test are shown in Table 2 below.

TABLE 2

| | Desulfurization Agent (% by weight) | |
|---|---|---|
| | A | C |
| Initial Sulfur in Iron Melt* | 0.1 | 0.11 |
| Final Sulfur in Iron Melt* | 0.034 | 0.028 |
| Residual $CaC_2$ in Slag* | 2.72 | 0.091 |
| Amount Commercial $CaC_2$ in Agent | 100 | 77 |
| Amount CAS in Agent | 0 | 20 |
| Amount $Fe_2O_3$ in Agent | 0 | 3 |

*average of two runs

These tests were conducted in a manner similar to Example 1 above, except nitrogen gas was used instead of argon.

A reagent grade of ferric oxide was used.

The test for the residual calcium carbide was conducted in the same manner as Example 1 above.

The desulfurization agent of the present invention used in this example was made in a manner as outlined in Example 1 above except a reagent grade of particulate ferric oxide was mixed with the calcium carbide and the calcium aluminate slag and the loose particles were compacted. Agent A was in loose particulate form.

EXAMPLE 3

This example illustrates different formulations of the desulfurization agent of the present invention.

TABLE 3

| | Desulfurization Agent**(% by Weight) | | | | | |
|---|---|---|---|---|---|---|
| | A | D | E | F | G | H |
| Initial Sulfur In Iron Melt* | 0.13 | 0.145 | 0.1 | 0.12 | 0.135 | 0.155 |
| Final Sulfur In Iron Melt* | 0.006 | 0.0055 | 0.005 | 0.01 | 0.0055 | 0.005 |
| Residual $CaC_2$ In Slag* | 5.47 | 0.18 | 0.1 | 0.134 | 0.11 | 0.1 |
| Amount Commercial $CaC_2$ in Agent | 100 | 77 | 82 | 87 | 82 | 82 |
| Amount CAS in Agent | 0 | 20 | 15 | 10 | 15 | 15 |
| Amount $Fe_3O_4$ In Agent | 0 | 3 | 3 | 3 | 0 | 0 |
| Amount $Mn_3O_4$ In Agent | 0 | 0 | 0 | 0 | 3 | 3 |

*All of these tests were based on two runs each.
**Each agent was in compacted form.

The ferrosoferric oxide, $Fe_3O_4$, was pigment grade obtained from Shance Chemical Corp. Desulfurization agent G was made with reagent grade $Mn_3O_4$ while H was made with pigment grade manganomanganic oxide obtained from Elkem Metals Company under the name M34.

The amount of residual calcium carbide in the slag was determined in this example by weighing out a 15 g sample of the slag, crushing the sample to pass through a 10 mesh screen and placing that sample in a closed 8 cu. ft. vessel along with a jar containing 200 ml of 10% hydrochloric acid solution. The vessel was sealed and slag was immersed in acidic solution. Any acetylene generated by the reaction of water and calcium carbide is contained within the vessel. A sample of the acetylene/air mixture was drawn from the vessel at 5 minute intervals. The percentage acetylene in the air was then measured using conventional gas chromatographic techniques with a Foxbourgh gas chromatograph. The percent calcium carbide was calculated from the percent of acetylene in the air. The readings were taken for one hour.

It has been found that this test provides a very accurate method for determining the actual amount of residual calcium carbide in the slag.

EXAMPLE 4

This example illustrates use of the desulfurization agent of the present invention in a commercial operation.

In a conventional desulfurization operation, loose particulate commercial calcium carbide having a size of 10 mesh × 60 mesh was used at an addition rate of 0.75% by weight based on the weight of the iron melt. The amount of residual calcium carbide in the slag using the commercial calcium carbide was 18% by weight of slag.

The desulfurization agent H of Example 3 above, compacted and subsequently ground to a particulate size of about 12 mesh × 30 mesh, was used to replace the commercial calcium carbide. Desulfurization agent H was added to the melt at a rate of 0.4% by weight. The process used a continuous desulfurization ladle with one porous plug in the bottom thereof.

The iron melt during desulfurization by both commercial calcium carbide and the desulfurization agent of the present invention had a typical analysis before desulfurization of:

| | % by Weight |
|---|---|
| Iron | Balance |
| Carbon | 3.85 |
| Silicon | 1.95 |
| Manganese | 0.30 |
| Sulfur | 0.065 |
| Phosphorus | 0.025 |

Typically, the iron after desulfurization with both commercial calcium carbide and the desulfurization agent of the present invention had a sulfur content of about 0.008 percent by weight.

In both cases, desulfurization with commercial calcium carbide and with the desulfurization agent of the present invention, the residence time of the iron in the desulfurization ladle was about six minutes.

The residual calcium carbide in the slag recovered from the melt after desulfurization with the desulfurization agent of the present invention was about 0.43% by weight based on slag. The percent calcium carbide in the slag for both the commercial calcium carbide and the desulfurization agent of the present invention was determined in accordance with the method disclosed in Example 3 above.

EXAMPLE 5

This example illustrates using the desulfurization agent of the present invention compared to the process taught in U.S. Pat. No. 4,753,676 issued June 28, 1988 in a commercial operation.

The '676 patent as mentioned above teaches using a mixture of commercial calcium carbide and diamide of lime, 85% by weight calcium carbonate, $CaCO_2$, and 11% by weight carbon, to desulfurize an iron melt.

Both desulfurization agents, the one of the '676 patent and the one of the present invention, were added to the iron melt at 0.5% by weight based on the weight of the iron melt. The residence time of the iron in the desulfurization ladle was between about 6 to 8 minutes.

The desulfurization ladle was similar to the desulfurization ladle used in Example 4 except it contained three porous plugs.

The iron melt had a typical composition analysis similar to the iron melt of Example 4 except the silicon content was lower, about 1.5% by weight, and the sulfur content was higher, 0.7% by weight.

Compacted desulfurization agent H of Example 3 was used having a particulate size of 12 mesh×30 mesh.

The commercial calcium carbide-diamide lime composition typically produced an iron with 0.01% by weight sulfur and typically a slag of 0.4% by weight residual calcium carbide.

The desulfurization agent of the present invention typically produced an iron melt with 0.01% by weight sulfur and typically a slag of 0.3% by weight residual calcium carbide. The amount of residual calcium carbide for both the calcium carbide-diamide lime and the desulfurization agent of the present invention was determined by the method disclosed in Example 4.

EXAMPLE 6

In batchwise commercial scale operation, the desulfurization agent of the present invention, compacted, particulate desulfurization agent H of Example 3 above, was tested against commercial calcium carbide. In this operation, typically 0.3% by weight of both desulfurization agents were added to the ladle and residence time in the ladle of the iron and desulfurization agent was typically 16 minutes.

The iron melt typically had a chemical analysis of:

| | % by Weight Melt |
|---|---|
| Iron | Balance |
| Carbon | 3.85 |
| Silicon | 1.3 |
| Manganese | 0.25 |
| Sulfur | 0.11 |
| Phosphorus | 0.025 |

Using both the commercial calcium carbide and the desulfurization agent of the present invention, the treated iron melt typically had a sulfur content of about 0.01% by weight.

The residual calcium carbide in the slag obtained from the desulfurization process using commercial calcium carbide averaged 0.88% by weight slag while the residual calcium carbide in the slag obtained from the desulfurization process using the desulfurization agent of the present invention averaged about 0.086% by weight.

It will be understood that it is intended to cover all changes and modifications of the preferred embodiments herein chosen for the purpose of illustration which do not constitute a departure from the spirit and scope of the invention.

What is claimed is:

1. A method for making a desulfurization agent for molten iron comprising the steps of forming a molten composition of a calcium oxide; a calcium fluoride; and an aluminum oxide; rapidly cooling said molten composition to a solid composition; and combining said solid composition with a commercial calcium carbide to form a desulfurizing agent.

2. A process for reducing residual calcium carbide in slag from an iron melt comprising the steps of:

(a) desulfurizing an iron melt with a desulfurization agent consisting essentially of:
- about 95 to 70% by weight of commercial calcium carbide,
- about 5 to 30% by weight of calcium aluminate slag which consists essentially of:
  - about 65 to 50% by weight calcium oxide,
  - about 25 to 35% by weight aluminum oxide,
  - about 3 to 12% by weight calcium fluoride, about 0 to 10% by weight of a metal oxide selected from the group consisting of ferric oxide, manganomanganic oxide and ferrosoferric oxide; and (b) removing resulting slag from the surface of the iron melt.

3. A desulfurizing agent for an iron melt which minimizes the amount of residual calcium carbide in the slag, said desulfurization agent consisting essentially of:
- about 95 to 70% by weight of commercial calcium carbide,
- about 5 to 30% by weight of calcium aluminate slag which consists essentially of:
  - about 65 to 50% by weight calcium oxide,
  - about 25 to 35% by weight aluminum oxide,
  - about 3 to 12% by weight calcium fluoride,
  - about 0 to 10% by weight of a metal oxide selected from the group consisting of ferric oxide, manganomanganic oxide and ferrosoferric oxide.

4. The process of claim 2 wherein the desulfurization agent consisting essentially of about 90 to about 75% by weight commercial calcium carbide, about 10 to about 20% by weight calcium aluminate slag and about 1 to about 6% by weight of manganomanganic oxide.

5. The process of claim 2 wherein said desulfurization agent is mixed with said melt in an amount of about 0.2 to about 2.0% by weight of melt.

6. The agent of claim 3 wherein said agent consisting essentially of about 90 to about 75% by weight commercial calcium carbide; about 10 to about 20% by weight of said calcium aluminum slag; and about 1 to about 6% by weight of said metal oxide.

7. The agent of claim 3 wherein said agent consisting essentially of about 80 to about 85% by weight commercial calcium carbide; about 13 to about 17% by weight said calcium aluminum slag; and about 2 to about 4% by weight manganomanganic oxide.

8. The agent of claim 3 wherein said calcium aluminum slag consisting essentially of about 65 to about 50% by weight calcium oxide; about 3 to about 12% by weight calcium fluoride; and about 35 to about 25% by weight aluminum oxide.

9. The agent of claim 3 wherein said calcium aluminum slag consisting essentially of about 58 to about 52% calcium oxide; about 32 to 25% by weight aluminum oxide; and 9 to 5% by weight calcium fluoride.

10. The agent of claim 3 in a loose mixture in a particulate form.

11. The agent of claim 3 in a compacted mixture in a particulate form.

12. The method of claim 1 further comprising the step of adding a metal oxide selected from the group consisting essentially of ferric oxide, manganomanganic oxide and ferrosoferric oxide.

* * * * *